US009810048B2

(12) United States Patent
Balun

(10) Patent No.: US 9,810,048 B2
(45) Date of Patent: Nov. 7, 2017

(54) PERFORATING GUN

(71) Applicant: BENTELER STEEL/TUBE GMBH, Paderborn (DE)

(72) Inventor: Jozef Balun, Paderborn (DE)

(73) Assignee: Benteler Steel/Tube GmbH, Paderborn (DE)

( * ) Notice: Subject to any disclaimer, the term of this patent is extended or adjusted under 35 U.S.C. 154(b) by 0 days.

(21) Appl. No.: 14/863,070

(22) Filed: Sep. 23, 2015

(65) Prior Publication Data

US 2017/0081948 A1 Mar. 23, 2017

(51) Int. Cl.
*E21B 43/116* (2006.01)

(52) U.S. Cl.
CPC ..... *E21B 43/116* (2013.01)

(58) Field of Classification Search
CPC ..... E21B 43/116; E21B 43/117; E21B 43/119
See application file for complete search history.

(56) References Cited

U.S. PATENT DOCUMENTS 3,048,102 A * 8/1962 Lebourg ..... E21B 43/117 102/310
3,605,777 A 9/1971 Curry et al.
4,919,050 A * 4/1990 Dobrinski ..... E21B 43/117 102/307
4,966,750 A 10/1990 LaSalle et al.
6,302,027 B1 10/2001 Compton et al.
6,464,019 B1 10/2002 Werner et al.
6,702,039 B2 * 3/2004 Parrott ..... B21C 1/22 102/321.1
6,941,871 B2 * 9/2005 Mauldin ..... E21B 43/119 102/310
8,794,326 B2 8/2014 Le et al.
2002/0134585 A1 * 9/2002 Walker ..... E21B 43/117 175/4.51
2002/0189483 A1 12/2002 Parrott et al.
2003/0188867 A1 * 10/2003 Parrott ..... E21B 17/05 166/297
2005/0139352 A1 * 6/2005 Mauldin ..... E21B 43/116 166/55
2009/0050334 A1 2/2009 Marya et al.
2009/0288833 A1 11/2009 Graham et al.
2010/0300750 A1 * 12/2010 Hales ..... E21B 43/117 175/2
2014/0041515 A1 2/2014 Mauldin
(Continued)

FOREIGN PATENT DOCUMENTS

WO WO 2014/182304 11/2014

OTHER PUBLICATIONS

Official Action for U.S. Appl. No. 15/137,892, dated May 18, 2017 13 pages.

*Primary Examiner* — Gabriel Klein
(74) *Attorney, Agent, or Firm* — Sheridan Ross PC

(57) ABSTRACT

The invention relates to a perforating gun used for hydraulic fracturing applications in a wellbore
and has an outer tube having several recesses of a second kind. The recesses of a second kind are configured to absorb shock waves from a shape charge in the perforating gun to reduce the numbers of cracks that form on the perforating pun. In some embodiments, the recesses of a second kind have a variety of shapes and sizes to aid in the absorption of shock waves.

19 Claims, 6 Drawing Sheets

(56) References Cited

U.S. PATENT DOCUMENTS

| | | | | |
|---|---|---|---|---|
| 2014/0053715 | A1* | 2/2014 | Zhang | E21B 43/116 89/1.15 |
| 2015/0152704 | A1 | 6/2015 | Tunget | |
| 2015/0285026 | A1 | 10/2015 | Frazier | |
| 2017/0028437 | A1 | 2/2017 | Holly et al. | |
| 2017/0107799 | A1 | 4/2017 | Rodgers et al. | |

* cited by examiner

PERFORATING GUN

BACKGROUND

The invention relates to an apparatus for the exploration and recovery of petroleum and natural gas by the means of output wells. Especially the invention relates to a perforating gun as claimed in the preamble of patent claim 1. In particular with such apparatuses the recovery of petroleum and natural gas is possible by the means of so called fracking. Fracturing is a well-stimulation technique in which rock is fractured by a pressurized liquid. The process involves the high-pressure injection of a fracking fluid into a wellbore to create cracks in the deep-rock formations through which natural gas and petroleum will flow more freely. When the hydraulic pressure is removed from the well, small grains of hydraulic fracturing proppants (either sand or aluminum oxide) hold the fractures open. Therefore into the casing of a wellbore at least one perforating gun is placed and subsurface explosions are performed by the means of such a perforating gung. Such a perforating gun is disclosed in U.S. Pat. No. 8,794,326 B2 . The perforating gun comprising an outer tube which is designed as a tubular housing of the perforating gun having several recesses and an inner tube within the outer tube which is designed as a charge holder to hold a plurality of shape charges. Each recess is designed for corresponding to one shape charge so that after ignition and detonation of the shape charges a high pressure and high speed jet is generated and directed to the corresponding recess. These jets permeate the recesses of the outer tube and run into the layer of earth in radial direction of the perforating gun. Thereby on the one hand the outer tube has to withstand a large compression pressure, which is built up by the earth mass into depth where the perforation gun is placed. On the other hand the outer tube has to be free of deformation during and after the detonation of the shape charges to make it possible that the perforation gun can be removed from the casing of the wellbore.

US 2014 041 515 A1 and WO 2014 182 304 A1 disclose perforating guns as well, whereby the improvement of the design and the setting up of the recesses into the outer tube are discussed.

US 2002 189 483 A1 discloses the mechanical stress of the outer tube during the ignition of the shape charges of the perforation gun and during the expansion of the jets. Thereby the problem of the propagation of the shock waves into the outer tube of the perforation gun by impact of the jets onto the outer tube is discussed. Therefore an improvement of the design of the recesses of the outer tube is recommended to influence the expansion of the jets and the shock waves in a positive matter.

SUMMARY

The object of the invention is therefore to provide a perforating gun with which the appearance of cracks on the perforating gun during the designated use especially during the explosion of the shape charges is decreased. Especially the risk of cracks on the outer region of the outer tube should be avoided.

This object is achieved by means of a perforating gun having all the features of patent claim 1. Advantageous embodiments of the invention can be found in the dependent claims.

The Perforating gun of the invention comprises an outer tube which is designed as a tubular housing of the perforating gun with a wall thickness and having several recesses of a first kind with a depth less than wall thickness of the outer tube and an inner tube within the outer tube which is designed as a charge holder to hold a plurality of shape charges.

Each recess of a first kind is corresponding to one shape charge and each shape charge having an opening directed to the corresponding recess of a first kind so that after detonation of the shape charges a high pressure and high speed jet is generated and directed to the corresponding recess of the first kind. Furthermore the outer tube having several recesses of a second kind with a depth less than wall thickness.

The recesses of the second kind are designed for modification of a stress condition by controlling the shock wave propagation after ignition and explosion of the shape charges, in particular a compression wave or a shear or tension wave propagation, within the tubular housing of the outer tube, respectively, in order to prevent crack initiation. Therefore, the recesses of the second kind avoid an interference of the shockwave after ignition and explosion of the shape charges which could lead to crack initiation by means of influence of the propagation of those shock waves. Compression waves act thereby on the surface of the outer tube of the perforating gun in radial direction. The propagation of those compression waves is at first effective in and then opposite to the direction of the propagation of the jet after ignition and explosion of the shape charges. Thereby in the point of impact shear waves or parts of them are developing which are propagating along the inward surface of the outer tube or the tubular housing of the perforation gun in clockwise and counter clockwise direction. Typically cracks are developing in an outer region of the cross section of the outer tube or the tubular housing of the perforating gun in an angle region between 60 and 120 degrees from the jet propagation direction. Is a shear wave now impacting a recess of a second kind, this shear wave will be reflected and/or diffracted and/or absorbed by local deformation of the structure. At all cases an unhindered propagation of the shockwaves caused by ignition and explosion of the shape charges is prevented, so that crack initiation in the outer tube or the tubular housing of the perforating gun is effective reduced and minimized by the invention.

According to a first advantageous embodiment of the invention, the recess of the first kind are having a first recessed volume and the recess of the second kind are having a second recessed volume, wherein at least one of following relations are met:

a first depth of the recesses of the first kind is greater than a second depth of the recesses of the second kind, the first recessed volume of the recesses of the first kind is greater than the second recessed volume of the recesses the second kind.

By this means it is possible that the outer tube could withstand a very large compression pressure in extreme deep earth layers, whereby the structural integrity of the outer tube is not weakened inadmissible by the recesses of the second kind. Furthermore it is possible that between two adjacent recesses of the first kind a plurality of smaller recesses of the second kind are placed. Thus, the effect of scattering of the compression waves and the shear waves in particular onto the inward surface of the outer tube of the tubular housing of the perforating gun is increases because these waves are reflected and/or diffracted and/or absorbed and therefore weakened on one or more of the recesses of the second kind.

Preferable the tubular housing extending in an axial direction with a length, the recesses of the second kind are arranged in an offset relation to each other along the length and along the circumference of the outer tube or tubular housing. Thus, it is possible to weaken the propagation of the waves and the shear wave in particular along the length of the outer tube and along the direction of the circumference of the outer tube or tubular housing.

Even more preferable, the offset in axial direction between two adjacent recesses of the second kind is at least equal and at most two time the diameter of the second volume of the recess of the second kind and the offset in circumference direction between those two adjacent recesses is at least three time and at most five time the diameter of the second volume of the recess of the second kind. Also by this means it is ensured that no inadmissible weakening of the outer tube or the tubular housing of the perforating gun is appeared through the compression pressure of the earth layers. On the other side also it is ensured almost certainly that the compression waves or the shear waves, respectively, hit a recess of the second kind along the circumference of the outer tube or tubular housing al least once so that the waves will be reflected and/or diffracted and/or absorbed and therefore weakened.

According to a further concept of the invention it is still preferable that the recesses of the second kind are constituted conically with two V-shaped edges and an opening with an angle $\alpha$ between the edges between 30 degrees and 150 degrees. Preferable the angle $\alpha$ is between 110 degrees and 150 degrees. By this means it is reached, that a shear wave is refracted after impacting an edge of a recess of the second kind. A more acute angle results in a higher absorption of the wave while a less acute angle results in a higher reflection. If the angle is to much acute then the shear wave is reflected to its source. In contrast, a to less acute angle result increases the probability that the wave will not hit any other recess of the second kind so that the wave is weakened only insufficient.

In another embodiment the recesses of the second kind are shaped selected from the group consisting of U-shaped, cup-shaped, polygonal shaped or cuboid shaped. This embodiment of the recesses of the second kind could be reached by means of metal cutting like milling or the like.

In still another embodiment the recesses of the second kind are shaped in the surface of the outer tube and selected from the group consisting of U-shaped and cup-shaped and constituted with a valley and two hills extending from the valley in axial direction, the valley having a bottom directed radially inward to the tubular housing and the hills having tops extending radially outwards to the tubular housing. Thereby it is possible to reach an ideal weakening of the shear waves on the one hand while on the other hand a crack critical interference of a plurality of waves is prevented. The production process of a perforating gun according to the invention could be suitable for series production by this means. For example embossing rollers which act on the outward surface of the outer tube could be used during production of the perforating gun. Also the recesses of the first kind can be produced with the same method very economically.

The outer tube or tubular housing is made a steel composition with yield strength of at least 450 Mega Pascal (MPa).

The steel is thereby preferred chosen out of the group of heat treatable steel case hardened steel ferritic steel stainless steel In a preferred embodiment the outer tube or tubular housing is made of high strength steel having a yield strength of at least 900 MPa, more preferable at least 1200 MPa. By this means the weight of the outer tube and the perforating gun can be reduced and thereby material can saved and cost of transportation and handling can be reduced.

Further objectives, advantages, features and application possibilities of the present invention can be found in the following description of the exemplary embodiments with reference to the drawings. In this context, all the described and/or figuratively illustrated features form the subject matter of the present invention, either per se or in any appropriate combination, also independently of their combination in the claims or their back reference.

DETAILED DESCRIPTION OF THE DRAWINGS

Figure 1:
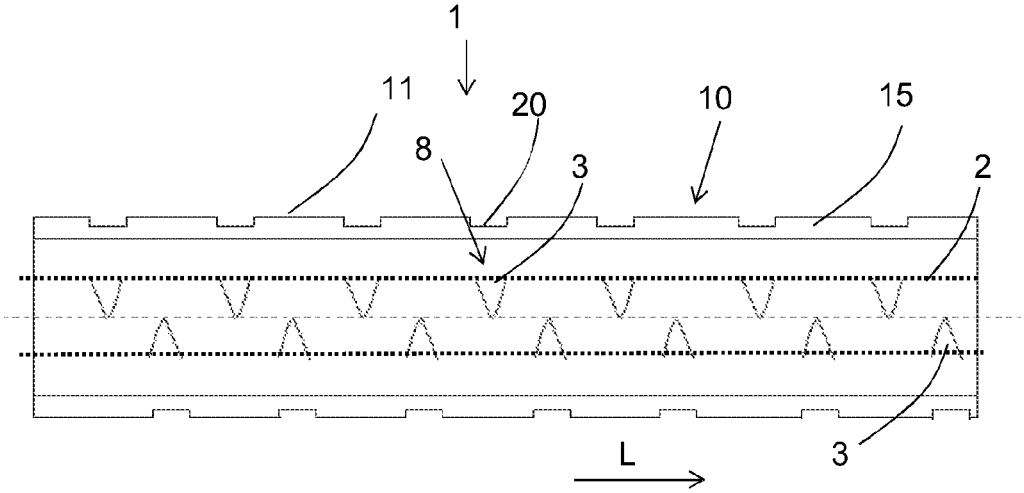
Figure 1 (Prior Art)
FIG. 1 discloses a perforating gun according to the prior art.

FIG. 1 discloses a perforating gun 1 regarding to the prior art. An outer tube 10 of a perforating gun 1 is shown in which an inner tube 2 with a plurality of shape charges 3 is placed. Corresponding to each shape charge 3 recesses 20 of a first kind are formed on the outward surface 11 of the outer tube 10.

Figure 9A:
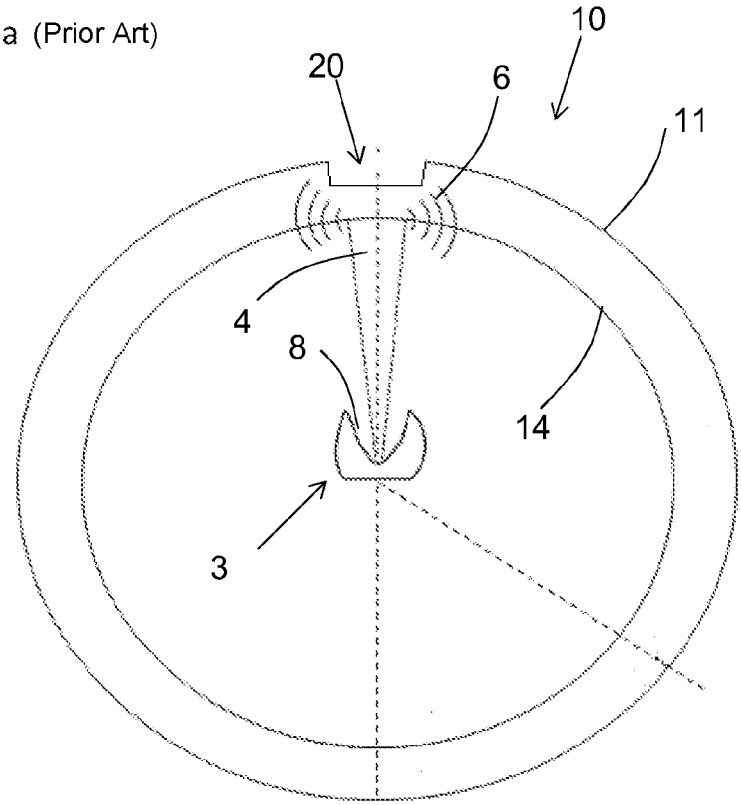
Figure 9a (Prior Art)
FIG. 9*a* shows a cross section of an outer tube of a perforating gun of a prior art.
Figure 9B:
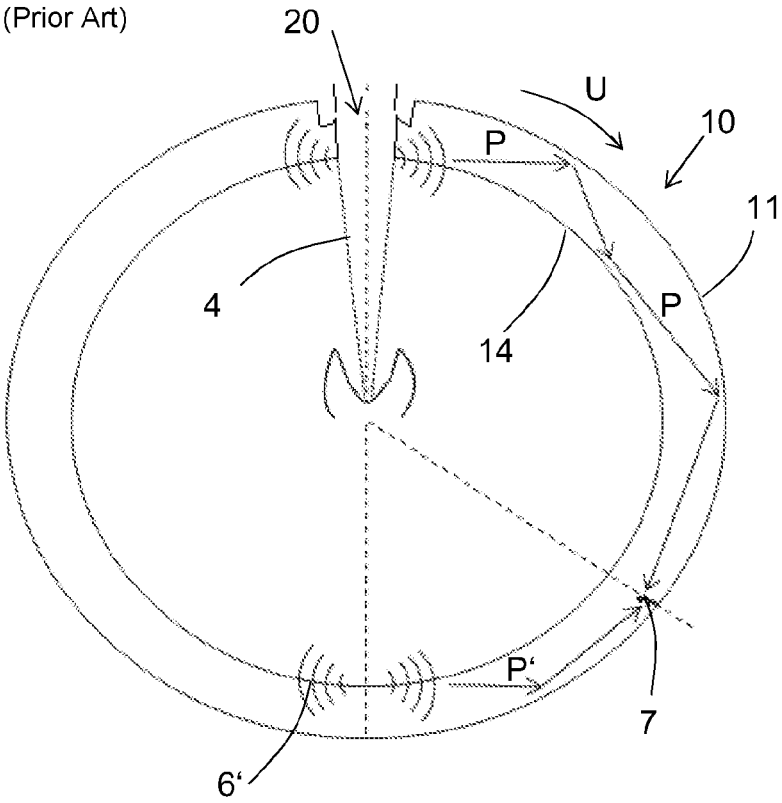
Figure 9b (Prior Art)
FIG. 9*b* shows another view of a cross section of an outer tube of a perforating gun of a prior art.

By ignition of a shape charge 3 a so called jet 4 is generated which breaks through the outer tube 10 at a recess 20 of the first kind in radial direction as it is shown in FIGS. 9*a* and 9*b* for the prior art.

Figure 2:
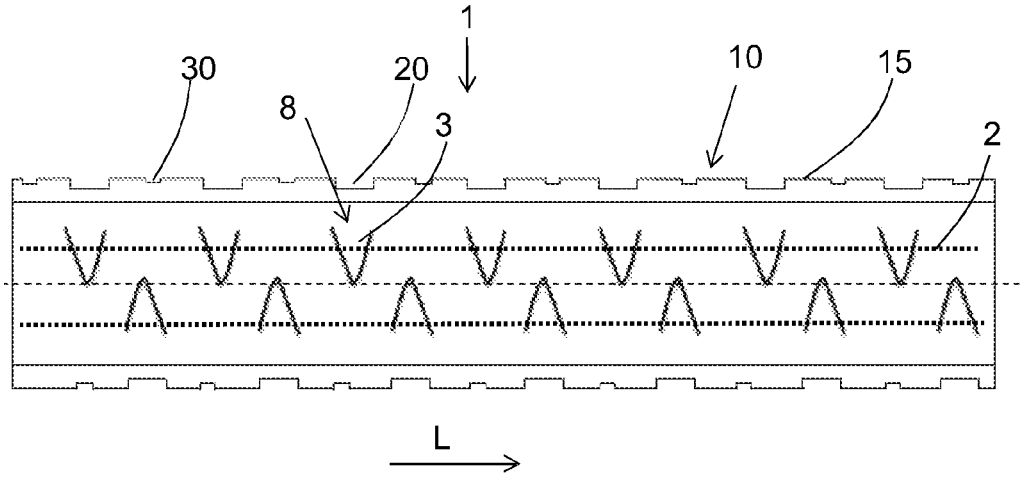
FIG. 2 shows a longitudinal section of the first embodiment of the invention.

Furthermore a first embodiment of the invention is shown in FIG. 2 in a longitudinal section. The perforating gun 1 comprises an outer tube 10 in which an inner tube 2 is placed. Along a length L of the outer tube 10 between two recesses 20 of the first kind a recess 30 of a second kind is placed. The outer tube comprises beneath the recesses 20 of the first kind recesses 30 of a second kind, whereby between two recesses 20 of the first kind one recess 30 of the second kind is placed. Furthermore it can be seen that the geometry of the recesses 20 and 30 are similar in each other appearance. However, the recesses 30 of the second kind are much smaller than the recesses 20 of the first kind. This relates as well to the width as to the depth of the recesses 20 and 30. Furthermore it is shown that recesses 20 of the first kind are not placed directly vis-á-vis on the different sides of the outer tube 10. Rather there is an offset between recesses 20 of the first kind on different sides of the outer tube 10. Similarly thereto there is an offset between recesses 30 of the second kind on different sides of the outer tube 10.

Figure 3:
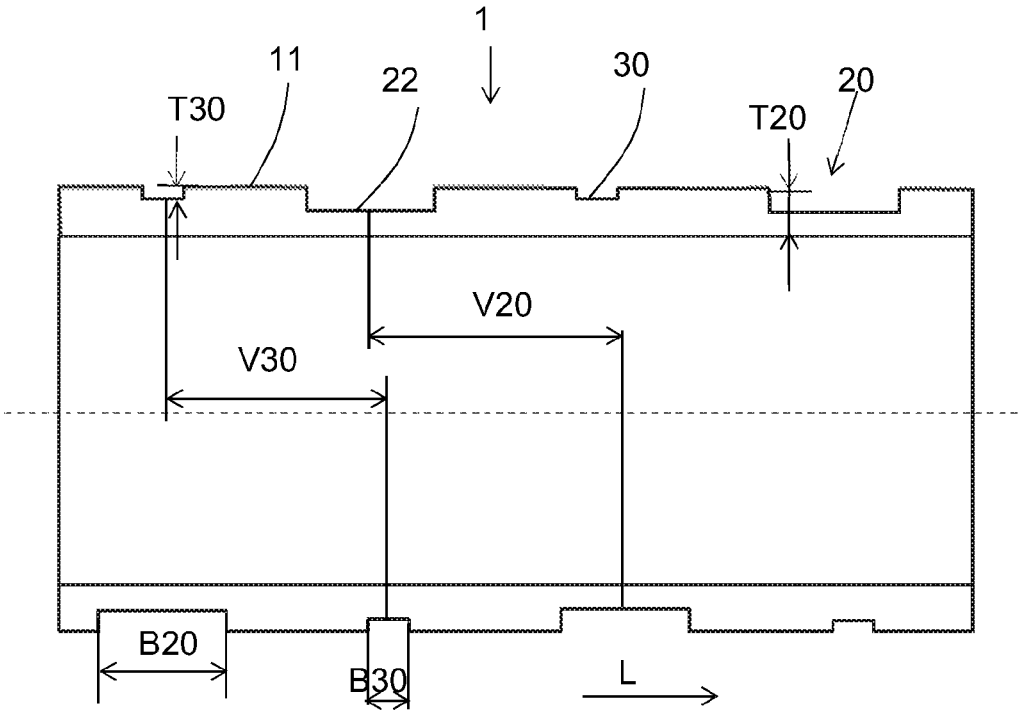
FIG. 3 shows a further embodiment of the invention with an enlarged representation of the outer tube.

FIG. 3 shows a further embodiment of the invention with an enlarged representation of the outer tube 10. The outer tube 10 has a plurality of recesses 20 of the first kind and a plurality of recesses 30 of the second kind. The outer tube 10 has wall thickness 13, which is reduced locally by the recesses 20 and 30. As shown recesses 20 of the first kind have a width of B20 while the recesses 30 of the second kind have a width of B30 which is less than the half of the width B20 of the recesses of the first kind. Furthermore the recesses 20 of the first kind have a depth of T20 while the recesses 30 of the second kind have a depth of T30 which is less than the half of the depth B20 of the recesses of the first kind. Furthermore an offset V20 between two recesses 20 of the first kind on different sides of the outer tube 10 is as well recognizable as an offset V30 between two recesses 30 of the first kind on different sides of the outer tube 10.

Figure 4:
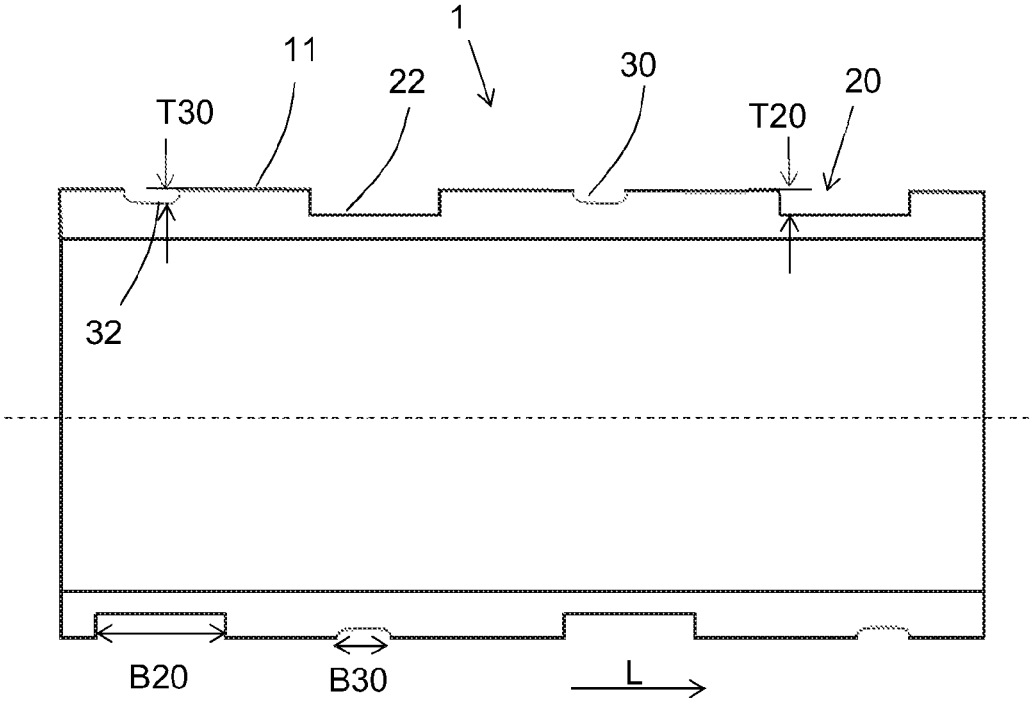
FIG. 4 show another embodiment of the invention with an outer tube similar to that of FIG. 3.

FIG. 4 show another embodiment of the invention with an outer tube 10 similar to that of FIG. 3. Also here are a plurality of recesses 20 and 30 of a first and a second kind is place on a outward surface 11 of the outer tube 10. The recesses 30 of the second kind have also a depth T30 and a width B30, wherein the recess 30 have a U-formed longitudinal section with a bottom 32 which is directed away from the outward surface 11 of the outer tube 10. The depth T30 is measured from the outward surface 11 of the outer tube 10 to the bottom 32 of the recess 30 of the second kind. As in FIG. 3 the depth T20 is measured from the outward surface 11 of the outer tube 10 to the bottom 22 of the recess 20 of the first kind.

Figure 5:
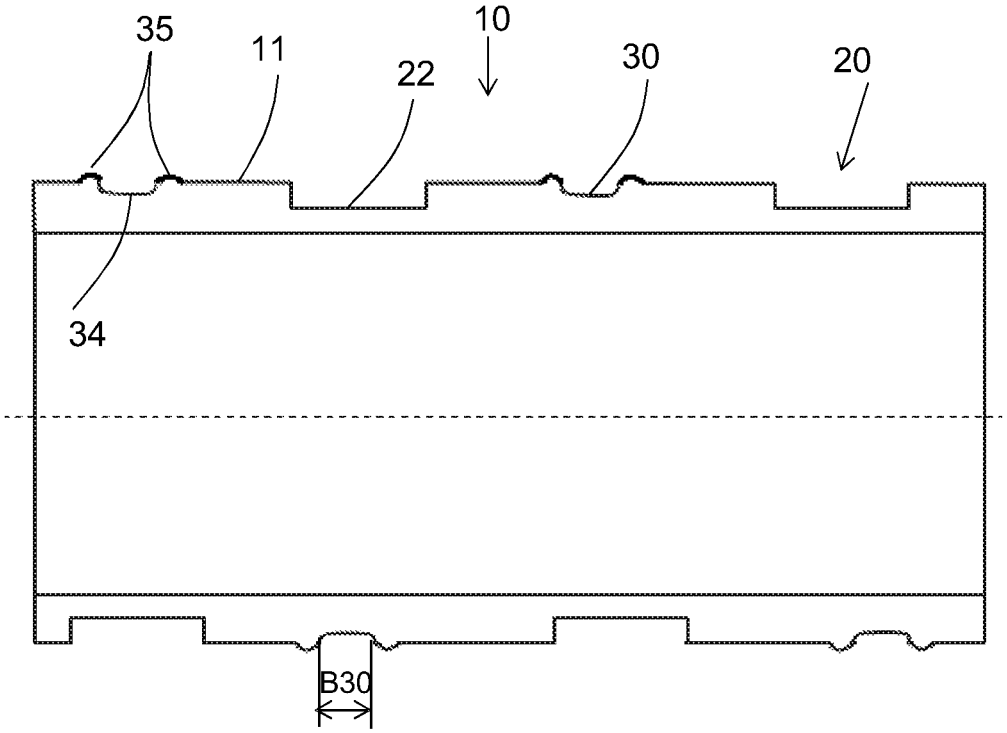
FIG. 5 shows an embodiment in a longitudinal section of the outer tube whereby a plurality of recesses and of a first and a second kind are placed on the outward surface of the outer tube.

A further embodiment of the invention is shown in FIG. 5. Also this embodiment is shown in a longitudinal section of the outer tube 10 whereby a plurality of recesses 20 and 30 of a first and a second kind are place on the outward surface 11 of the outer tube 10. The recesses 30 of the second kind of this embodiment have a valley region 34 directed away from the outward surface 11 of the outer tube 10 as well as hill regions 35 directed away from the valley region 34 on the outward surface 11 of the outer tube 10. The valley region 34 is limited downwards in inward direction of the outer tube 10 by a bottom 32 while the hill region 35 extends on both sides of the valley regions 34 from the outward surfacell of the outer tube 10 in radial direction.

Figure 6:
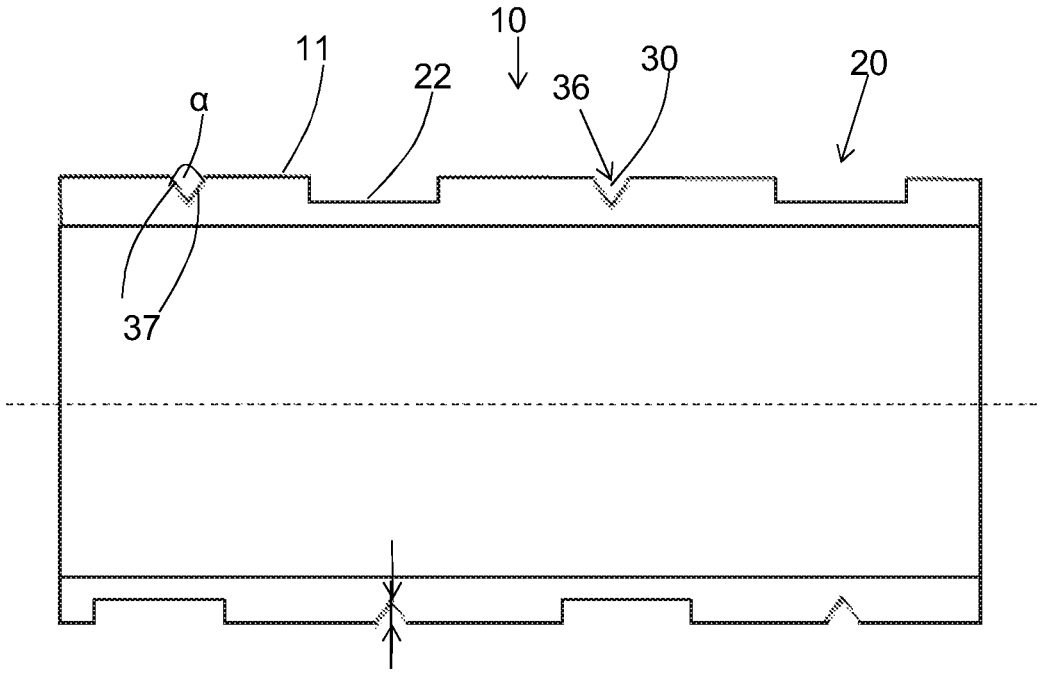
FIG. 6 shows an embodiment in a longitudinal section of the outer tube whereby a plurality of recesses and of a first and a second kind are placed on the outward surface of the outer tube.

A further embodiment of the invention is shown in FIG. 6. Also this embodiment is shown in a longitudinal section of the outer tube 10 whereby a plurality of recesses 20 and 30 of a first and a second kind are place on the outward surface 11 of the outer tube 10. The outer tube 10 of this embodiment comprises recesses 30 of a second kind which have a v-form. The v-formed recesses 30 have an opening 36 which is formed by two edges 37. The edges 37 are forming in an angle α which is formed acute. The angle α in this embodiment is about 60 degrees. The depth of the recesses 20 and 30 of the first and second kind in this embodiment is almost equal.

Figure 7:
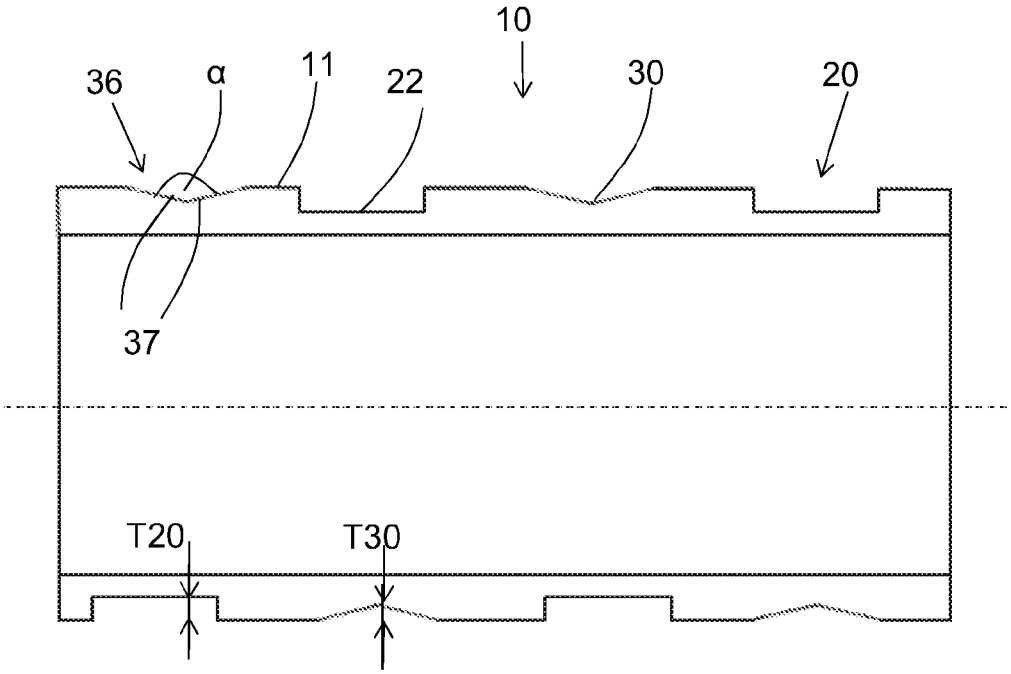
FIG. 7 shows an embodiment in a longitudinal section of the outer tube whereby a plurality of recesses and of a first and a second kind are placed on the outward surface of the outer tube.

Another embodiment of the invention is shown in FIG. 7. Also this embodiment is shown in a longitudinal section of the outer tube 10 whereby a plurality of recesses 20 and 30 of a first and a second kind are place on the outward surface 11 of the outer tube 10. The outer tube 10 of this embodiment comprises recesses 30 of a second kind which have a v-form. The edges 37 are forming an angle α which is formed obtuse. The angle α in this embodiment is about 120 degrees. In this embodiment the depth of the recesses 20 of the first kind is deeper than the depth of the recesses 30 of the second kind is.

Figure 8:
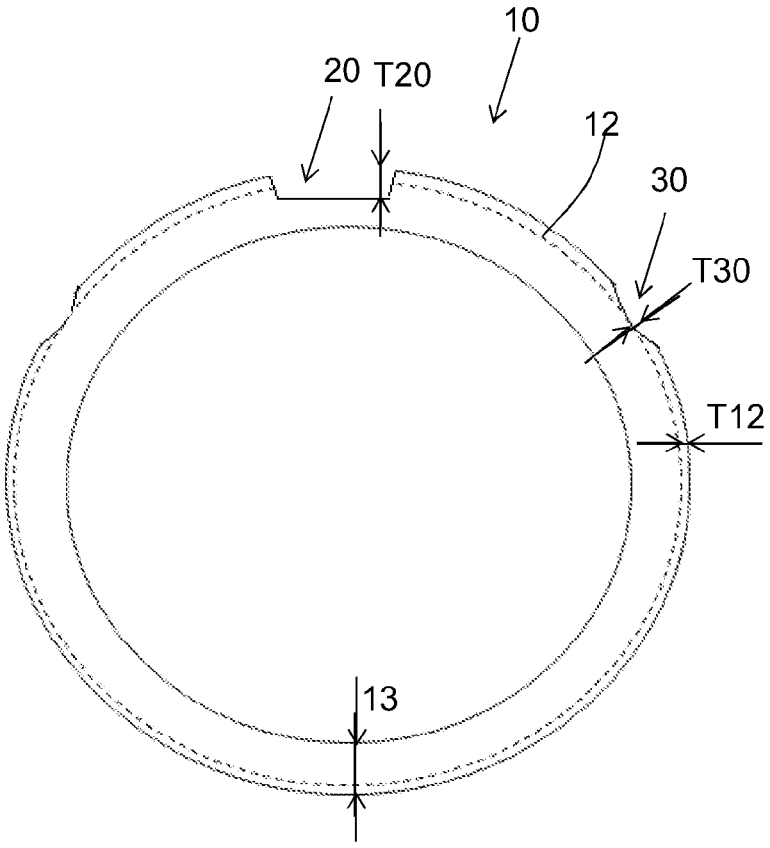
FIG. 8 shows a cross section of an outer tube of a perforating gun in an embodiment of the invention.

FIG. 8 shows a cross section of an outer tube 10 of a perforating gun 1 in an embodiment of the invention. In addition to recesses 20 of a first kind with a depth T20 u-formed recesses 30 of a second kind with a depth T30 are shown. From the outward surface 11 of the outer tube 10 the recesses 30 extend within a depth T12 in a region 12 within the outer tube 10 which has a wall thickness 13. The region 12 with the depth T12 has thereby a reduced hardness in comparison to the other regions of the wall 38 of the outer tube 10.

FIGS. 9*a* and 9*b* show a cross section of an outer tube 10 of a perforating gun 1 of a prior art. A shape charge 3 is placed on a here not shown inner tube within the outer tube 10. The shape charge 3 has an opening 8 which directs in radial direction onto a recess 20 of a first kind. After ignition and explosion of the shape charge 3 a so called jet 4 is generated which propagates upwards onto the recess 20 of the first kind. This is shown in FIG. 9*a*. The jet 4 hits an inward surface 14 of the outer tube10 which is deformed and passed through by the jet 4. This is shown in FIG. 9*b*. By hitting the inward surface 14 of the outer tube 6 the jet 4 inject shear waves 6 and compression waves 5 into the outer tube 10 between its inward surface 14 and its outward surface 11. Also by the pass through of the recess 20 by the jet 4 within the outer tube 10 between its inward surface 14 and its outward surface 11 shear waves 6 appear which extend into circumferences direction U of the outer tube 10. As shown in the lower half of FIG. 9*b* also on the opposite side of the impact of the jet 4 shear waves 6' appears by a blowback after ignition and explosion of the shape charge 3. The different waves, in particular the shear waves 6 and 6', indicated by arrows P, run on each other in the outer tube 10 between its inward surface 14 and its outward surface 11 and hit each other under an angle between 60 degrees and 120 degrees from the expansion of the jet 4. The waves now interfere with each other in that matter that a crack 7 can occur, which start from the outward surface 11 of the outer tube 10.

Figure 10A:
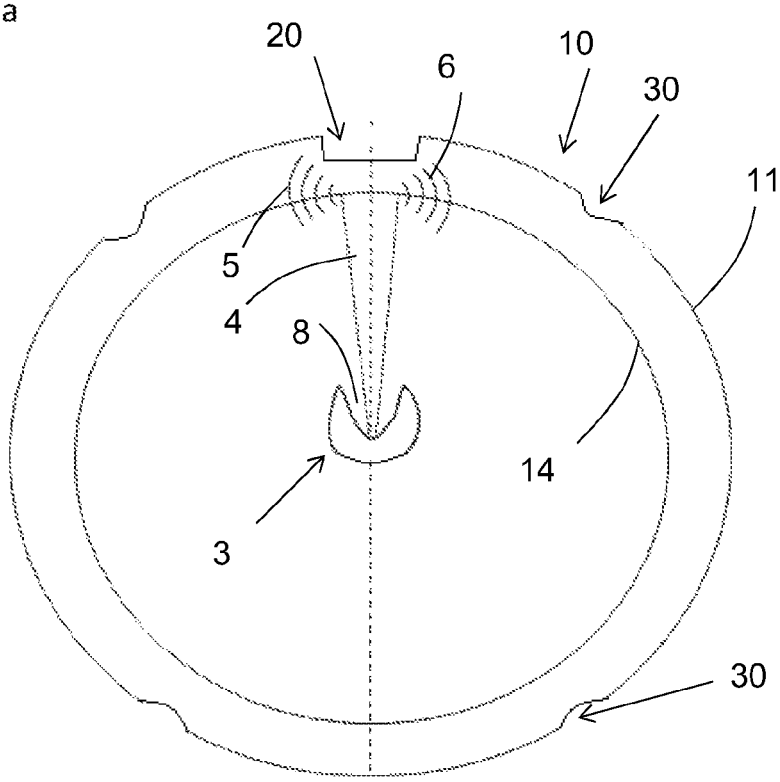
FIG. 10*a* shows the principle of the invention in another view of a cross section of an outer tube of a perforating gun of the invention.
Figure 10B:
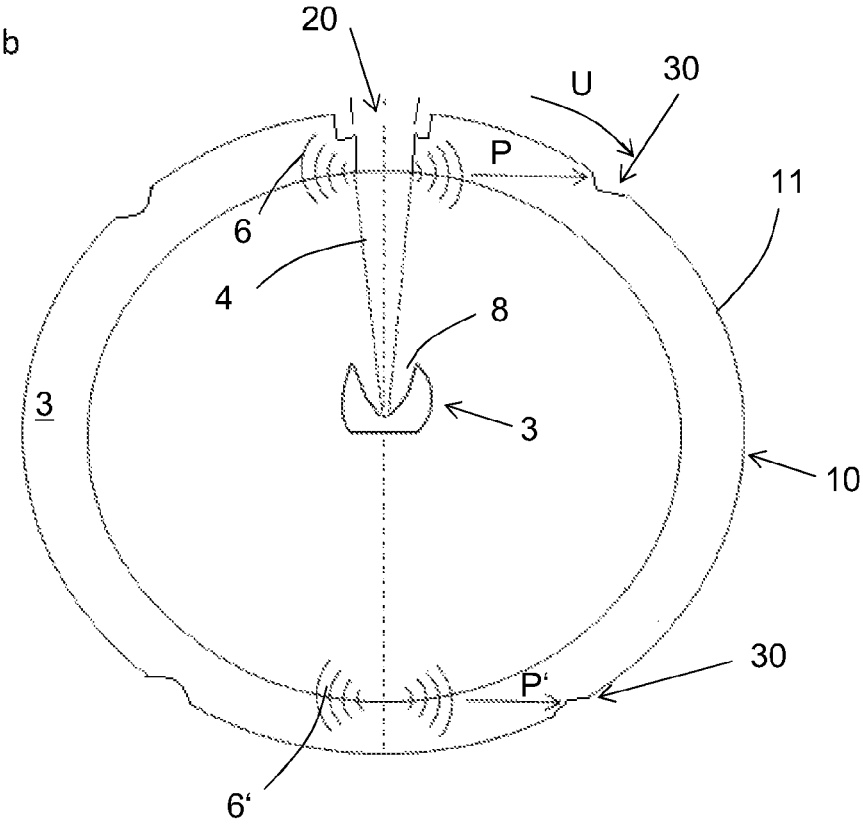
FIG. 10*b* shows the principle of the invention in another cross section of an outer tube of a perforating gun of the invention.

FIGS. 10*a* and 10*b* show the principle of the invention in a cross section of an outer tube 10 of a perforating gun 1 of the invention. FIG. 10 shows the moment after ignition and explosion of the shape charge 3 and the beginning propagation of the jet 4. The jet 4 hit the inward surface 14 of the outer tube 10 whereby compression waves 5 and shear waves 6 are generated and injected into the outer tube 10 between its inward surface 14 and its outward surface 11.

Additional to the recess 20 of the first kind, which is located in the outer tube 10 corresponding to the opening 8 of the shape charge 3, the outer tube 10 has recesses 30 of a second kind. These recesses 30 of the second kind are located in direction of the circumference of the outer tube 10 with a gap to the recess 20 of the first kind. In this embodiment the recesses 20 of the second kind have a u-form in its cross section. Alternatively, the form of the recesses 20 of the second kind can be different to the u-form, especially it can be designed with a v-form, polygonal or with a valley region and/or a hill region corresponding to the prior described embodiments of the invention.

In FIG. 10*b* the outer tube 10 is shown at a later moment. The jet 4 has already broken through the outer tube 11 in the region of the recess 20 of the first kind. Furthermore a shear wave 6 is shown which propagates in direction of the arrow P and hits a recess 30 of the second kind within the outer tube 10 between its inward surface 14 and its outward surface 11. This recess 30 of the second kind effects that in the point of contact of the shear wave 6 with the edge 37 of the recess 30 of the second kind a part of the energy of the shear wave 6 is absorbed and the shear wave 6 is reflected and/or deflected so that it is weakened and propagates with less energy. Another shear wave 6' is shown on the outer tube 10 opposite the opening 8 of the shape charge 3 which was formed by a blowback after ignition and explosion of the shape charge 3. This shear wave 6' also propagates within the outer tube 10 between its inward surface 14 and its outward surface 11 in direction of the arrow P' and hits another recess 30 of a second kind. There the shear wave 6' is partially absorbed, deflected and/or reflected. Therefore the recesses 30 of the second kind prevent that the shear waves 6 and 6' can unhindered propagate within the outer tube 10 between its inward surface 14 and its outward surface 11. This leads to a weakening of the shear waves 6 and 6'and its energy, so that no critical interferences of the shear waves 6 and 6' can occur which could lead to a crack initiation within the outer tube 10 of the perforating gun 1 on its outward surface 11.

REFERENCE SIGNS

1 perforating gun
2 inner tube
3 shape charge
4 jet
5 compression wave
6 shear wave
6' shear wave
7 crack
8 opening
10 outer tube
11 outward surface
12 region
13 wall thickness
14 inward surface
20 recess (of a first kind)
22 bottom
30 recess (of a second kind)
32 bottom
34 valley region
35 hill region
36 opening
37 edge
38 wall
B20 width
B30 width
T12 depth
T20 depth
T30 depth
P arrow
P' arrow
U direction of circumference
V20 offset
V30 offset
α angle

What is claimed is:

1. A perforating gun, comprising:

a) an outer tube which is a tubular housing of the perforating gun with a wall thickness and an outer surface, and the outer tube having a plurality of first recesses on the outer surface, wherein each first recess has a first depth that is less than the wall thickness of the outer tube, and b) an inner tube within the outer tube which is a charge holder that holds a plurality of shape charges, wherein each first recess corresponds to one shape charge and each shape charge has an opening directed to a corresponding first recess so that after detonation of the shape charges a high pressure and a high speed jet is generated and directed to the corresponding first recess, the outer tube having a plurality of second recesses on the outer surface, wherein each second recess has a second depth that is less than the wall thickness of the outer tube, wherein each second recess forms a continuous edge with the outer surface of the outer tube.

2. The perforating gun as claimed in claim 1, wherein the first recesses have a first recessed volume and the second recesses have a second recessed volume, wherein the first recessed volume of the first recesses is greater than the second recessed volume of the second recesses.

3. The perforating gun as claimed in claim 1, wherein the outer tube extends in an axial direction with a length L, the second recesses are arranged in an offset in the axial direction along the length L and an offset along a circumference direction of the outer tube.

4. The perforating gun as claimed in claim 3, wherein the offset in the axial direction between two adjacent second recesses is at least equal to and at most two times a diameter of a second volume of the second recesses; and the offset in the circumference direction between two adjacent second recesses is at least three times and at most five times the diameter of the second volume of the second recesses.

5. The perforating gun as claimed in claim 1, wherein the second recesses are constituted conically with two V-shaped legs and an opening with an angle αbetween the legs between 30° and 150°.

6. The perforating gun as claimed in claim 1, wherein the second recesses have a shape selected from the group consisting of U-shaped, cup-shaped, polygonally shaped or cuboid shaped.

7. The perforating gun as claimed in claim 1, wherein the second recesses have a shape selected from the group consisting of U-shaped and cup-shaped and constituted with a valley and two hills extending from the valley in axial direction, the valley having a bottom directed radially inward to the tubular housing and the hills having tops extending radially out-wards to the tubular housing.

8. The perforating gun as claimed in claim 1, wherein the tubular housing is made of steel having a yield strength of at least 500 MPa.

9. The perforating gun as claimed in claim 1, wherein the tubular housing is made of high strength steel having a yield strength of at least 900 MPa.

10. The perforating gun as claimed in claim 1, wherein the tubular housing is made of ultra-high strength steel having a yield strength of at least 1200 MPa.

11. The perforating gun as claimed in claim 1, wherein the first depth of the first recesses is greater than the second depth of the second recesses.

12. The perforating gun as claimed in claim 1, wherein the outer tube extends in an axial direction with a length L, wherein at least some of the first recesses and at least some of the second recesses alternate along a first line that is parallel with the axis direction along the length L.

13. The perforating gun as claimed in claim 12, wherein at least some of the first recesses and at least some of the second recesses alternate along a second line that is parallel with the axis direction along the length L, wherein the first line and the second line are positioned on opposing sides of the outer tube.

14. The perforating gun as claimed in claim 13, wherein first recesses of the first line are positioned opposite second recesses of the second line, and second recesses of the first line are positioned opposite first recesses of the second line.

15. The perforating gun as claimed in claim 1, wherein at least some of the second recesses are arranged in an offset along a circumference direction of the outer tube, wherein at least one second recess is offset from at least one first recess by between 60 degrees and 120 degrees along the circumference direction of the outer tube.

16. The perforating gun as claimed in claim 1, wherein the first recesses have an initial shape in a pre-detonation state that is distinct from a final shape in a post-detonation, and the second recesses have an initial shape in the pre-detonation state that is substantially similar to a final shape in the post-detonation state.

17. The perforating gun as claimed in claim 1, wherein multiple second recesses are offset from each other and from each first recess along a circumference direction of the outer tube.

18. The perforating gun as claimed in claim 1, wherein at least three second recesses are offset from each other and from each first recess along the circumference direction of the outer tube.

19. The perforating gun as claimed in claim 1, wherein each continuous edge of each second recess is a closed shape and defines a perimeter of each second recess.

* * * * *